US007589300B2

(12) United States Patent
Nojima

(10) Patent No.: US 7,589,300 B2
(45) Date of Patent: Sep. 15, 2009

(54) IMAGE HEATING APPARATUS

(75) Inventor: Koji Nojima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 11/414,179

(22) Filed: May 1, 2006

(65) Prior Publication Data

US 2006/0289482 A1 Dec. 28, 2006

(30) Foreign Application Priority Data

May 6, 2005 (JP) ..... 2005-135118

(51) Int. Cl.
*H05B 6/14* (2006.01)

(52) U.S. Cl. ..... 219/619; 399/330; 399/328

(58) Field of Classification Search ..... 219/619, 219/216; 399/328–336, 92, 250, 307
See application file for complete search history.

(56) References Cited

U.S. PATENT DOCUMENTS 5,752,150 A 5/1998 Kato et al. ..... 399/330
6,212,352 B1 * 4/2001 Kagawa et al. ..... 399/307
6,289,192 B1 * 9/2001 Nukada et al. ..... 399/250
2006/0138126 A1 * 6/2006 Watanabe ..... 219/619
2006/0140689 A1 * 6/2006 Echigo et al. ..... 399/328
2008/0038008 A1 2/2008 Fujita et al. ..... 399/92

FOREIGN PATENT DOCUMENTS

JP 9-197850 7/1997
JP 9-197859 7/1997
JP 2001-345166 12/2001

* cited by examiner

*Primary Examiner*—Quang T Van
(74) *Attorney, Agent, or Firm*—Fitzpatrick, Cella, Harper & Scinto

(57) ABSTRACT

An image heating apparatus is constituted by a coil unit, an image heating member, and a heat transfer member for transferring heat from the coil unit to the image heating member. The heat transfer member is disposed between an inner surface of the image heating member and the coil unit.

4 Claims, 9 Drawing Sheets

IMAGE HEATING APPARATUS

FIELD OF THE INVENTION AND RELATED ART

The present invention relates to an image heating apparatus of an electromagnetic induction-type suitable for a heat fixing apparatus for fixing a toner image on a recording material or a gloss-imparting apparatus for imparting gloss to an image on a recording material.

Conventional image heating apparatuses will be described with reference to FIGS. 6-9.

FIG. 6 is a constitutional view showing an embodiment of a heat fixing apparatus of an electromagnetic induction-type. FIG. 7 is an explanatory view of a coil portion comprising an exciting coil line wound about a magnetic core. FIG. 8 is an external perspective view of a resinous cover for mounting the coil portion.

An image forming apparatus using electrophotography includes, as shown in FIG. 6, a heat fixing apparatus 3 for melt-fixing an unfixed toner image t on a surface of a material P to be subjected to recording (recording material) as a permanently fixed image by applying heat and pressure to the recording material P as a material to be heated while interposing and conveying the recording material P, carrying electrostatically thereon the unfixed toner image t, between a heating roller 1 and a pressure roller 2 which create a nip portion N.

In such a heat fixing apparatus 3, the heating roller 1 is constituted by a cylindrical steel pipe as a heat generation member and an exciting coil unit 4 as a magnetic flux generation means is disposed inside the heating roller 1. Eddy current is generated in the heating roller 1 by magnetic flux generated from the exciting coil unit 4 to heat a neighborhood of the nip portion N of the heating roller 1 at approximately 180° C. through Joule heat. Such a method has been proposed.

The electromagnetic induction-type heat fixing apparatus 3 is characterized in that the heating roller itself generates heat, so that it is possible to decrease a time required to increase a temperature of the heating roller surface up to an appropriate temperature (fixing temperature during startup of the heat fixing apparatus 1 when compared with a conventional heat fixing apparatus of a heat roller type using a halogen lamp.

In the heat fixing apparatus 3 having such a characteristic feature, it is important that a predetermined magnetic flux is stably generated in the exciting coil unit 4. The exciting coil unit 4 includes a coil portion 5 and a holder 8. The coil portion 5 is constituted by winding an exciting coil line 7 about a magnetic core 6 having a T-cross section (FIG. 7). As the exciting coil line 7, an insulating coating electrical wire which surface is coated with a resinous layer is used. The holder 8 includes a resinous cover 9 (FIG. 8) and a resinous lid 10 and is configured so that the coil portion 5 is stored in the resinous cover 9 and a storage opening 9*a* of the resinous cover is closed by the resinous lid 10. Two external lead lines (coil supply lines) A and connected with the exciting coil line 7 of the coil portion 5 stored in the resinous cover 9 are connected to a high-frequency converter (not shown), from which a high-frequency power of 100-2000 kW is supplied to the exciting coil line 7. As a result, as described above, it is possible to cause the heating roller itself to generate Joule heat.

As described above, the exciting coil unit 4 is made compact so that it can be disposed inside the heating roller 1. Further, the exciting coil line 7 is wound at a high density and is disposed inside the heating roller 1. For this reason, there was a possibility that the exciting coil unit 4 is excessively heated up to a temperature higher than a fixing temperature, i.e., the exciting coil unit 4 is excessively heated due to heat radiation from the heating roller 1 and self-heating of the exciting coil line 7 to be heated to a temperature several tens of ° C. higher than the surface temperature (180° C.9 of the heating roller 1, thus causing the following problems a) and b).

a) In the exciting coil unit 4, an electrical resistance of the exciting coil line 7 is increased due to excessive temperature rise, thus lowering a generation efficiency of magnetic flux, i.e., a heat generation efficiency of the heating roller 1.

b) In the case where the exciting coil unit 4 is excessively increased in temperature, the resinous coating of the exciting coil line 7 is melted to impair insulating properties.

In order to solve these problems of the excessive temperature rise of the exciting coil unit 4, Japanese Laid-Open Patent Application (JP-A) 2001-345166 has proposed a method of air-cooling the exciting coil unit 4 with a cooling fan 30 by providing an air passage within the heating roller 1 as shown in FIG. 9. However, in this method, not only the exciting coil unit 4 but also the heated heating roller 1 were cooled together, so that there was a problem of a poor heat efficiency.

For this reason, JP-A Hei 09-197859 has proposed a method of cooling the excessively heated coil such that a copper plate or a heat pipe is disposed in contact with the coil in place of the cooling fan and an end portion of the copper plate or the heat pipe is exposed to the outside. According to this method, heat of the coil is dissipated from the externally exposed end portion through the copper plate or the heat pipe disposed in contact with the coil.

However, the cooling method proposed in JP-A Hei 09-197850 was accompanied with a problem of an increase in size of a resultant heat fixing apparatus due to such a constitution that the copper plate or the heat pipe for transferring the heat of the coil had the externally exposed end portion. Further, the heat of the coil is dissipated from the end portion to the outside, thus failing to be reutilized as heat for warming the heating roller or resulting in a poor heat utilization efficiency.

SUMMARY OF THE INVENTION

An object of the present invention is to provide a image heating apparatus having solved the above described problems.

A specific object of the present invention is to provide an image heating apparatus capable of alleviating excessive temperature rise of a coil unit while improving a reutilization efficiency of heat of the coil unit.

According to an aspect of the present invention, there is provided an image heating apparatus, comprising:

a coil unit having a coil which generates heat by energization;

an image heating member, provided with the coil unit therein, for generating heat by magnetic flux from the coil unit to heat an image on a recording material; and heat transfer means capable of transferring heat between surfaces by utilizing latent heat of a liquid sealed in the heat transfer mean, the heat transfer means having a first surface contacting the coil unit along a length of the heat transfer means and a second surface extending along an inner surface of the image heating member in contact with or with a spacing of 0.3-5 mm from the inner surface of the image heating member.

According to another aspect of the present invention, there is provided an image heating apparatus, comprising:

a coil unit having a coil which generates heat by energization;

an image heating member, provided with the coil unit therein, for generating heat by magnetic flux from the coil unit to heat an image on a recording material; and heat conductive member having a heat conductivity of not less than 50 kcal/(m.h. ° C.), the heat conductive member having a first surface contacting the coil unit along a length of the heat conductive member and a second surface extending along an inner surface of the image heating member in contact with or with a spacing of 0.3-5 mm from the inner surface of the image heating member.

According to a further aspect of the present invention, there is provided an image heating apparatus, comprising:

a coil unit having a coil which generates heat by energization;

an image heating member, provided with the coil unit therein, for generating heat by magnetic flux from the coil unit to heat an image on a recording material; and heat pump means having a heat absorption portion, disposed in contact with the coil unit, for absorbing heat and a heat dissipation portion, disposed in contact with or close to the image heating member, for dissipating heat.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First Embodiment (1) Embodiment of Image Forming Apparatus

Figure 1:
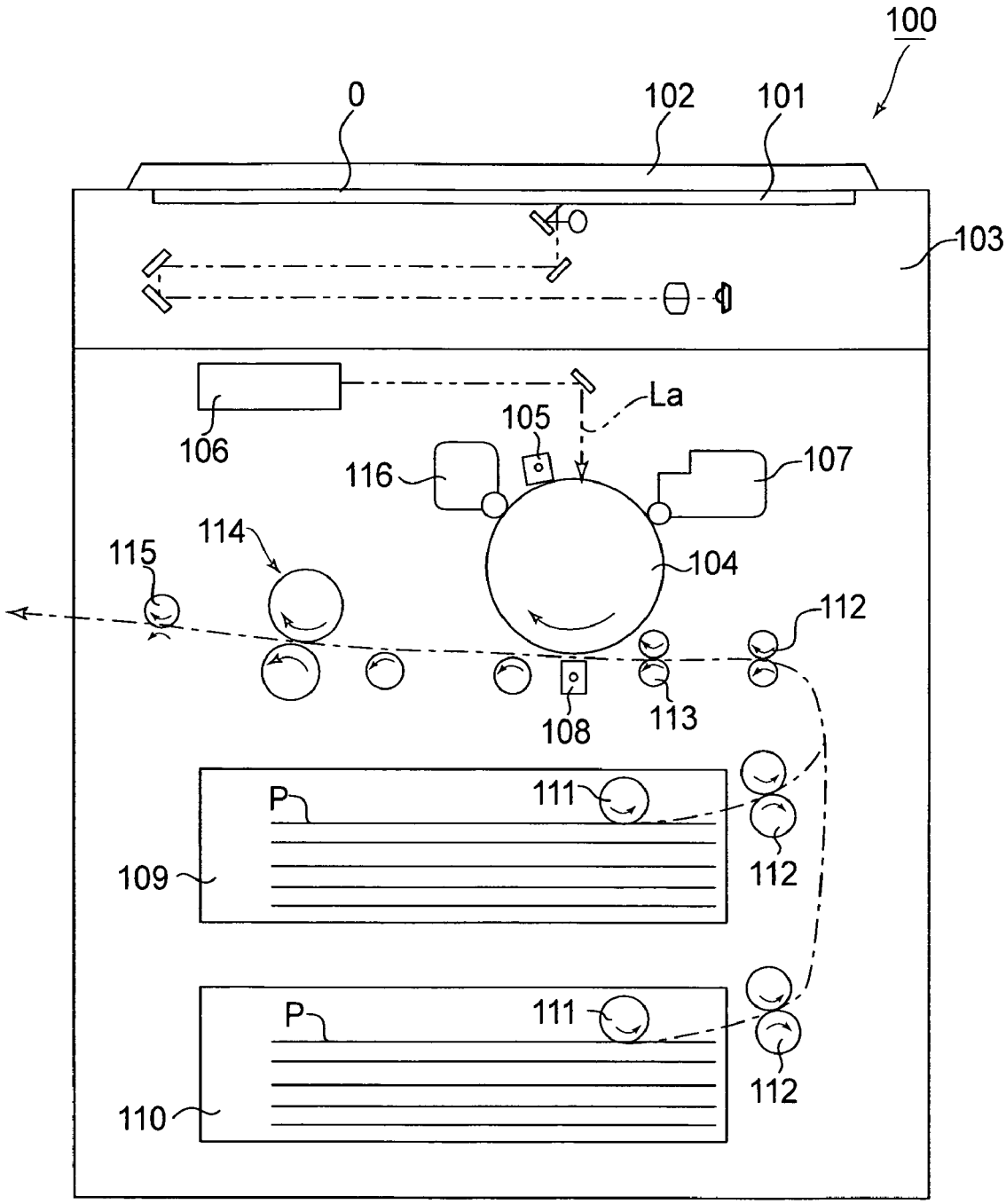
FIG. 1 is a schematic constitutional view showing an embodiment of an image forming apparatus.

FIG. 1 is a schematic structural view of an embodiment of an image forming apparatus provided, as an image heat-fixing apparatus with a heating apparatus of an electromagnetic induction heating type according to the present invention.

In this embodiment, an image forming apparatus 100 is a laser scanning exposure-type image forming apparatus (a copying machine, a printer, a facsimile machine, a multifunctional machine of these machines, etc.) utilizing a transfer-type electrophotographic process.

On an original supporting glass plate 101, an original O is placed face-down in accordance with a predetermined mounting standard and is covered with an original pressing late 102. When a copy start key is pressed, an image photoelectric reader (reader unit) 103 including a moving optical system is actuated to perform photoelectric reading processing of image information on the downward image surface of the original O placed on the original supporting glass plate 101. It is also possible to effect automatic feed of the original O onto the original supporting glass plate 101 by mounting an original automatic feeder (ADF, RDF) on the original supporting glass plate 101.

A rotary drum-type electrophotographic photosensitive member (hereinafter referred to as a "photosensitive drum") 104 is rotationally driven in a clockwise direction of an indicated arrow at a predetermined peripheral speed. During the rotation, the photosensitive drum 104 is uniformly charged electrically to a predetermined polarity and a predetermined potential by a charging apparatus 105. The uniformly charged surface of the photosensitive drum 104 is exposed imagewise to light La by an image writing apparatus 106 to be reduced in potential at an exposure light part, whereby an electrostatic latent image corresponding to an exposure pattern on the surface of the photosensitive drum 104. The image writing apparatus 106 used in this embodiment is a laser scanner and outputs laser light La modulated in correspondence with time-series electric digital pixel signal for the original image information photoelectrically read by the photoelectric reader 103 in accordance with instructions from an unshown controller, thereby to scan, for exposure, the uniformly charged surface of the rotating photosensitive drum 104, thus forming an electrostatic latent image corresponding to the original image information.

Next, the electrostatic latent image is developed as a toner image with toner by a developing apparatus 107. The toner image is electrostatically transferred from the surface of the photosensitive drum 104 onto a material to be subjected to recording as a material to be heated (hereinafter referred to as a "sheet") P which has been supplied to a transfer portion T, of a transfer charging apparatus 108, opposite to the photosensitive drum 104 from a sheet feeding mechanism portion at predetermined timing.

The sheet feeding mechanism portion of the image forming apparatus of this embodiment includes first and second sheet feeding cassette portions 109-112 and 110, from which the sheet P is selectively fed to the transfer portion at predetermined timing. From the sheet feeding cassette portions 109 and 110, a pickup roller 111 picks up and feeds the sheet P one by one and a feeding roller pair 112 further feeds the sheet P fed from the pickup roller 111. The sheet P is conveyed to a transfer portion at a predetermined timing by a registration roller pair 113.

The sheet P onto which the toner image has been transferred from the photosensitive drum 104 surface at the transfer portion is separated from the photosensitive drum 104 surface and conveyed to a fixing apparatus 114, as the image heating apparatus according to the present invention, by which an unfixed toner image is fixed on the sheet P, which is then discharged on an unshown output tray 118 located outside the image forming apparatus by a discharge roller 115.

On the other hand, the surface of the photosensitive drum 104 after the separation of the sheet P is cleaned by a cleaning apparatus 116 so as to remove residual toner remaining on the photosensitive drum 104. The photosensitive drum 104 is then repetitively subjected to image formation.

(2) Heating Fixing Apparatus 114

Figure 2:
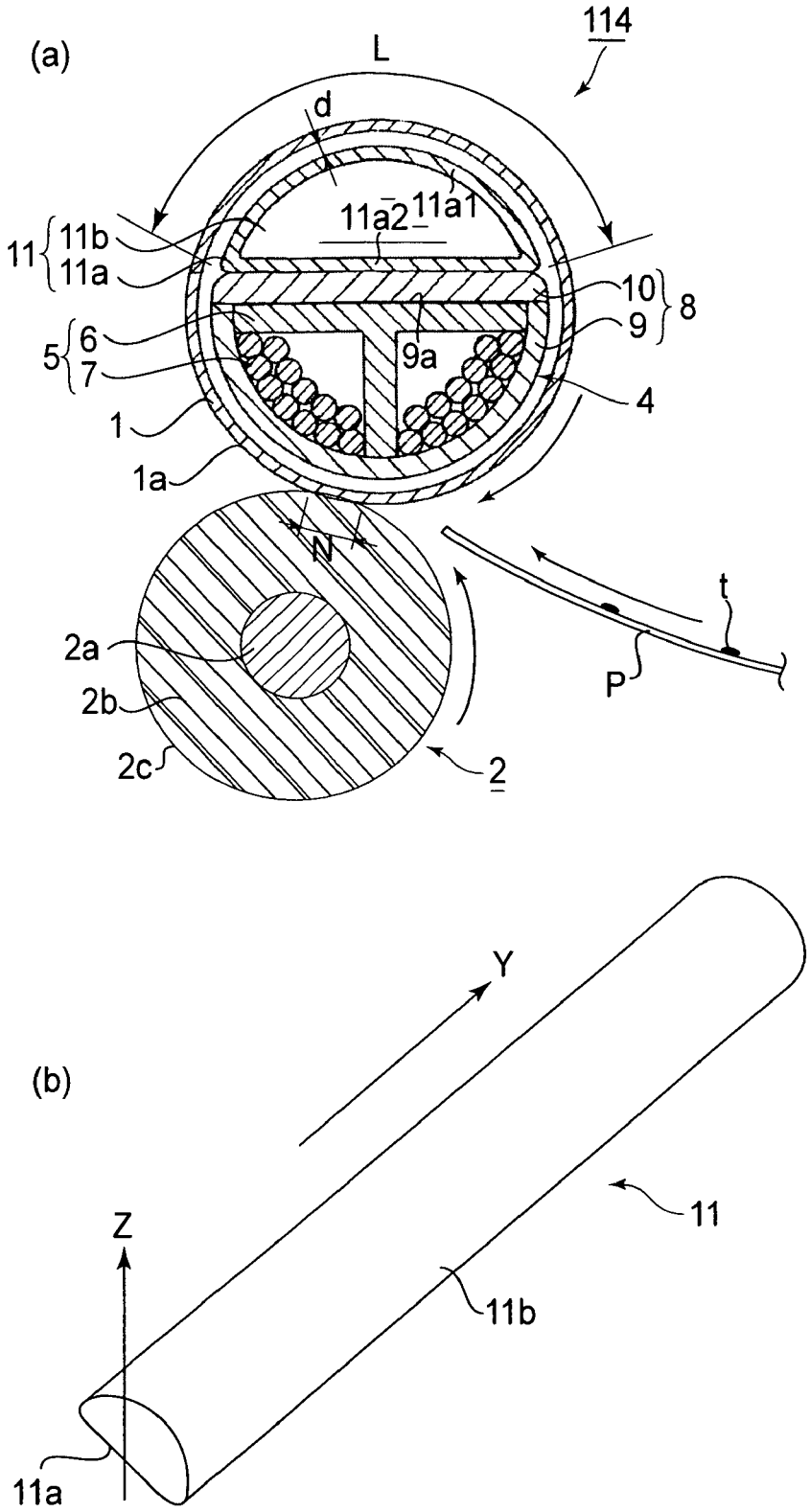
FIG. 2(*a*) is a cross-sectional constitutional view of a heat fixing apparatus according to First Embodiment of the present invention, and FIG. 2(*b*) is an explanatory view of a heat transfer direction of a heat pipe.
Figure 3:
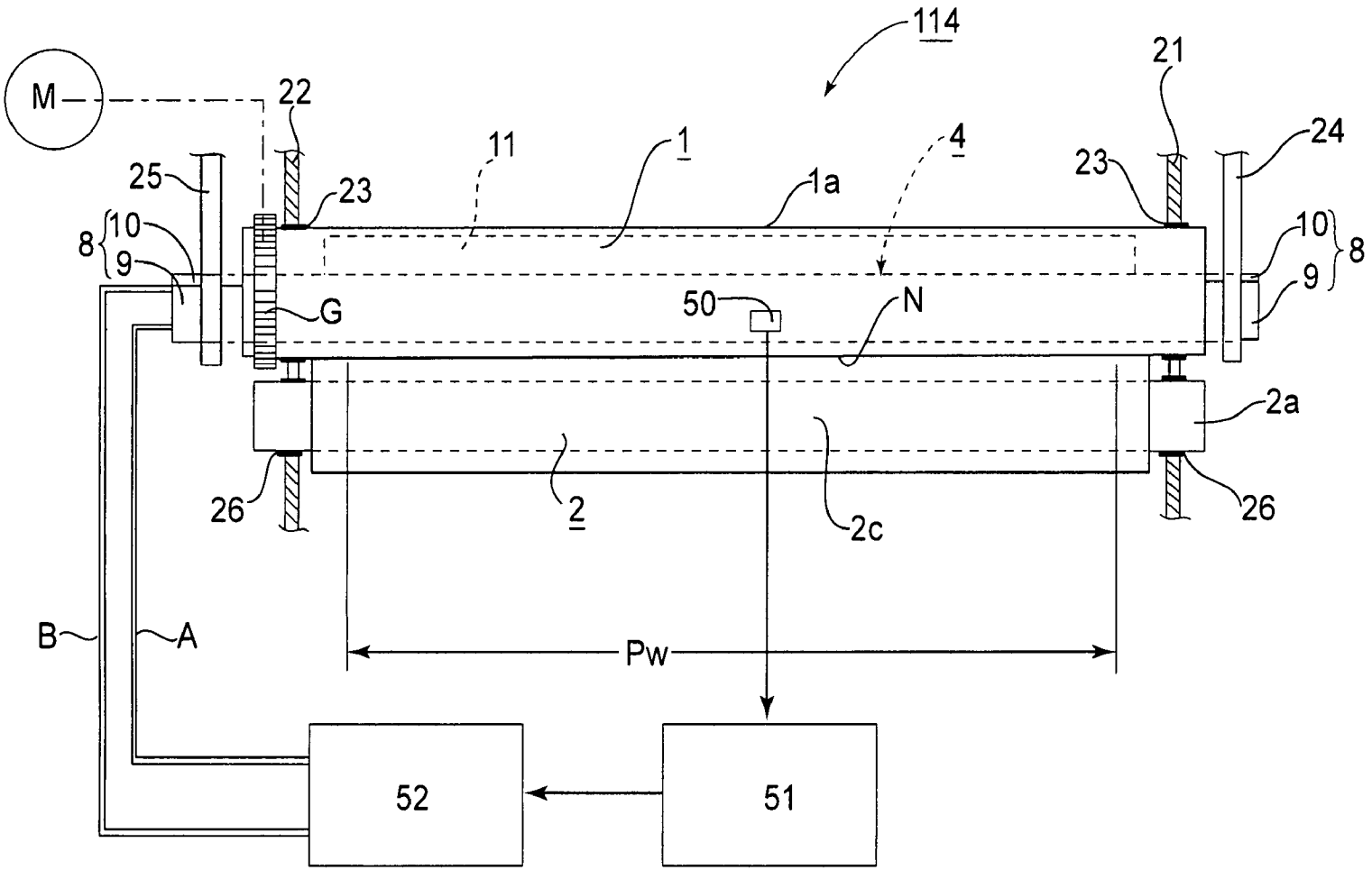
FIG. 3 is a front view of the heat fixing apparatus according to First Embodiment.
Figure 6:
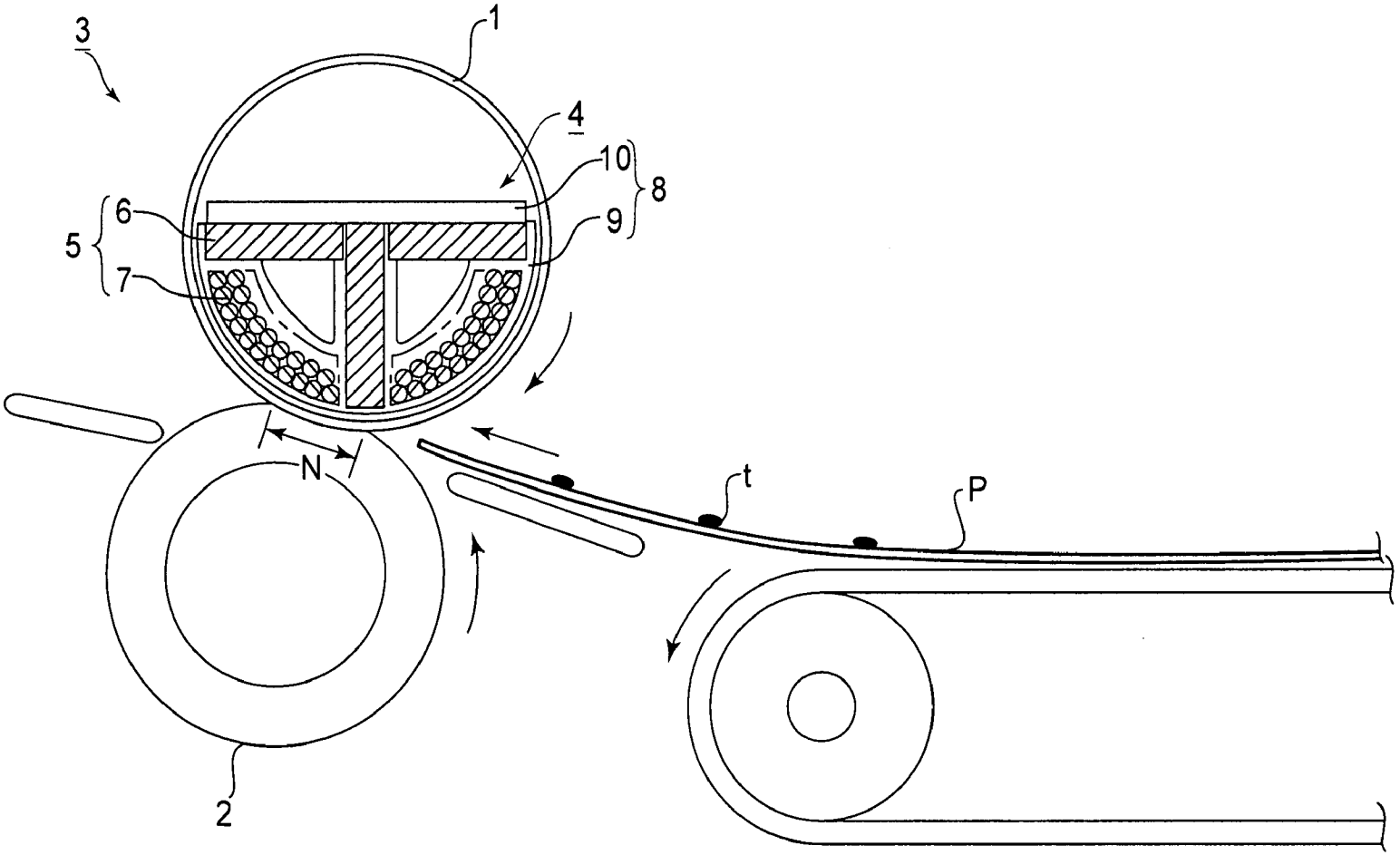
FIG. 6 is a constitutional view showing an embodiment of a conventional electromagnetic induction-type heat fixing apparatus.
Figure 7:
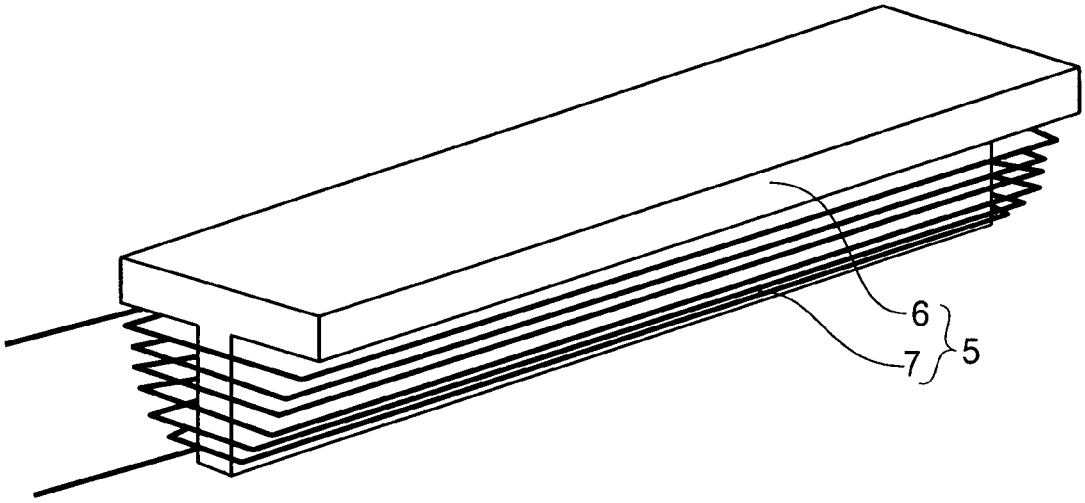
FIG. 7 is an explanatory view of a coil portion comprising an exciting coil line wound about a magnetic core.
Figure 8:
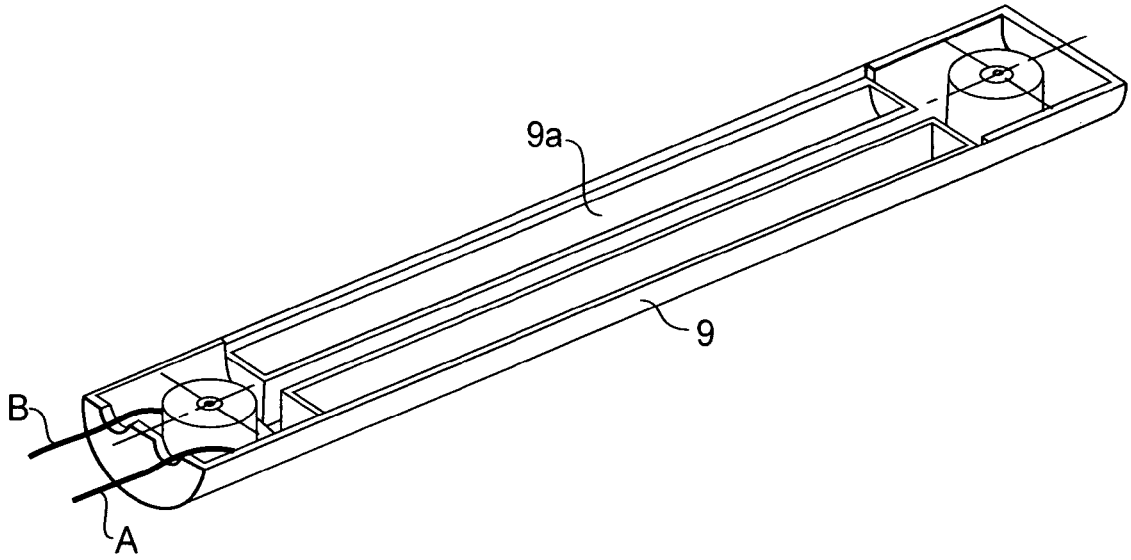
FIG. 8 is an external perspective view of a resinous cover for mounting the coil portion.
Figure 9:
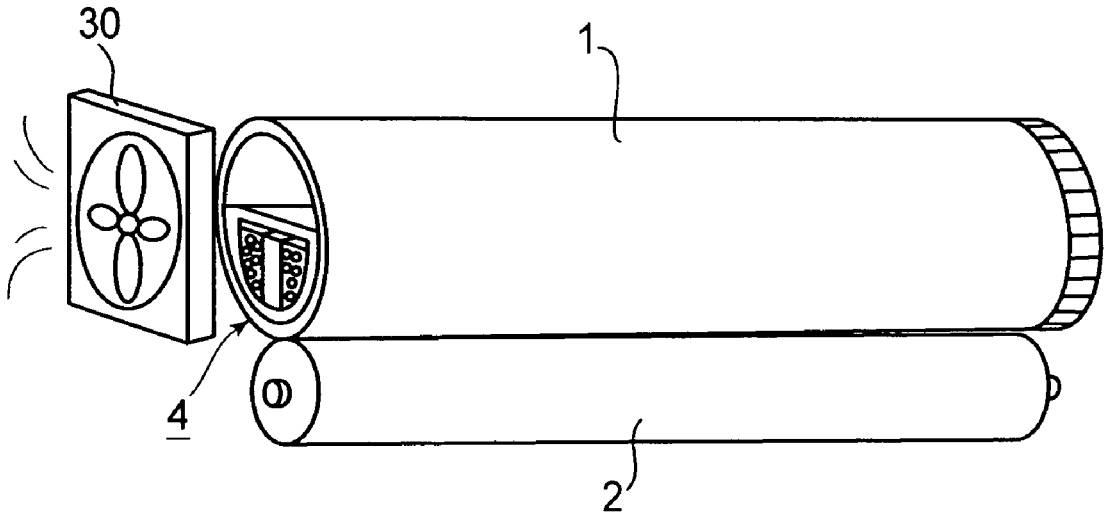
FIG. 9 is an explanatory view of a conventional electromagnetic induction-type heat fixing apparatus provided with a cooling fan.

FIG. 2(*a*) is a cross-sectional conventional view of a heat fixing apparatus according to this embodiment; FIG. 2(*b*) is an explanatory view of a heat transfer direction of a heat pipe disposed inside a heating roller of the heat fixing apparatus; and FIG. 3 is a front view of the heat fixing apparatus. In this embodiment, members of the heat fixing apparatus in common with a conventional fixing apparatus shown in FIGS. 6-8 are indicated by the same reference numerals or symbols.

This fixing apparatus 114 is a heating apparatus of an electromagnetic induction heating type. The fixing apparatus 114 principally includes two parallel upper and lower rollers consisting of a heating roller 1 as a heat generation member (or an image heating member) and a pressure roller 2 as a pressing member which are pressed against each other to create a fixation nip portion N.

The heating roller 1 is a hollow (cylindrical) roller (electromagnetic induction heating member) which is formed with an induction heating element. At an outer peripheral surface of the roller, a toner release layer 1*a* is formed. In this embodiment, the toner release layer 1*a* is formed of PTFE in a thickness of 30 μm.

The heating roller 1 is rotatably supported between side plates 21 and 22, located on the front and rear sides of the fixing apparatus, each via a bearing 23 at both end portions thereof. Further, at an inner hollow portion of the heating roller 1, a heating assembly (hereinafter referred to as an "exciting coil unit") 4 as a magnetic flux generation means, is injected and disposed so that it is fixedly supported by holding members 24 and 25 located on the front and rear sides of the fixing apparatus in a non-rotation state.

The pressure roller 2 is an elastic roller including an iron core shaft 2*a*, a silicone rubber heat-resistant elastic layer which is integrally and concentrically wound around the iron core shaft 2, and a toner release layer 2*c* formed at an outer surface of the elastic layer 2*b*. The toner release layer 2*c* is similar to the toner release layer 1*c* of the heating roller 1 described above. The pressure roller 2 is disposed under and in parallel with the heating roller 1 and is rotatably held between the side plates 21 and 22 (located on the front and near sides of the fixing apparatus) each via a bearing 26 at both end portions thereof. The pressure roller 2 is further pressed against the lower surface of the heating roller 1 by an unshown bias means while resisting an elasticity of the elastic layer 2*b*, thus forming the fixation nip portion N having the predetermined width.

Examples of the induction heating element constituting, as the electromagnetic induction heating member, the heating roller 1 may include magnetic metals or alloys (electroconductors or magnetic materials) such as nickel, iron, ferromagnetic SUS, iron-nickel alloy, iron-nickel-chromium alloy, and nickel-cobalt alloy.

The heating roller 1 may preferably be formed of metal, such as iron, nickel or cobalt. By use of ferromagnetic metal (having high permeability, it is possible to confine a larger amount of magnetic flux generated from the exciting coil unit 4 within the ferromagnetic metal. In other words, it is possible to increase a magnetic flux density. As a result, eddy current is effectively produced at the surface of the ferromagnetic metal to generate heat. The toner release layer 1*a* at the surface of the heating roller 1 may generally be formed of a 10-50 μm thick layer of PTFE or PFA. Further, it is also possible to provide a rubber layer disposed inside the toner release layer 1*a*.

The exciting coil unit 4 inserted into the hollow portion of the heating roller 1 is an assembly of a magnetic core 6 and an exciting coil line 7 which constitute a coil portion 5 and a resinous cover 9 and a resinous lid 10 which constitute a holder 8 (outer casing) 4, an exciting coil 5, magnetic cores 61 and 62, etc. In the resinous cover 9, the magnetic core 6 and the exciting coil line 7 are accommodated and held and a storage opening portion 9*a* of the resinous cover 9 on the magnetic core 6 side is closed by the resinous lid 10. The exciting coil unit 4 is inserted into the inner hollow portion of the heating roller 1 to be placed in a position with a predetermined angle and in such a state it holds a predetermined gap between it and the heating roller 1 in a noncontact manner, so that the exciting coil unit 4 is fixedly supported in a non-rotation manner by holding members 24 and 25 at both end portions the resinous cover 9 and the resinous lid 10 which are located on the front and rear sides of the fixing apparatus.

As a material for the resinous cover 9 and the resinous lid 10, it is possible to suitably use high heat-resistant resins, such as PPS-based resins, and LCP (liquid crystal polymer).

The exciting coil line 7 is required to generate a sufficient alternating magnetic flux for heating, so that it is necessary to provide a low resistance component and a high inductance component. As a core wire of the exciting coil line 7, a litz wire comprising a bundle of about 80-160 fine wires having a diameter of 0.1-0.3 mm. The fine wires comprise an insulating electric cable. The fine wires are wound around the magnetic core 6 plural times along the inner bottom shape of the resinous cover 9 in an elongated board form, thus providing the coil portion 5. The exciting coil line 7 is wound in a longitudinal direction (axial line direction) of the heating roller 1 and held by the inner wall of the holder 4 and the magnetic cores, and further is connected with two lead wires (coil supply wires) A and B which are led outward and is connected to a power control apparatus (exciting circuit) 52.

The magnetic core 6 is disposed in a T-shape at its cross section and may preferably be selected as a member or material, having a high magnetic susceptibility and a low loss, such as ferrite permalloy, etc.

A thermistor 50 as a temperature detection means for detecting the temperature of the heating roller 1 is disposed so that it is caused to elastically contact the surface of the heating roller 1 by pressing it against the heating roller surface by use of an unshown elastic member.

A detected temperature signal by the thermistor 50 is inputted into a control circuit 51. The temperature detection means 50 is not limited to the thermistor but may be other temperature detection devices of a contact type or a noncontact type.

When a main power switch of the image forming apparatus is turned on, the control circuit 51 actuates a drive source (motor) M. A rotational driving force of the drive source is transmitted to a heating roller gear G provided at one end portion of the heating roller 1 via a power transmission system, whereby the heating roller 1 is rotationally driven in a clockwise direction of an arrow at a predetermined peripheral speed as shown in FIG. 2. The pressure roller 2 is rotated by the rotation of the heating roller 1 in a counterclockwise direction of an arrow.

Further, the control circuit 51 actuates the power control apparatus 52 to supply electric power 5 (in this embodiment, a high-frequency current in the of 100-2000 KW) from the power control apparatus 52 to the exciting coil line 7 of the exciting coil unit 4 provided in the heating roller 1 via the coil supply lines A and B.

As a result, by the action and magnetic flux (alternating magnetic field) generated from the magnetic core 6 of the exciting coil unit 4, the heating roller 1 as the induction heating member generates heat (Joule heat by eddy-current loss). The temperature of this heating roller 1 is detected by the thermistor 50, and the detected temperature signal is inputted into the control circuit 51. The control circuit 51 adjusts the fixation roller temperature by controlling the supplied power from the power control assembly 52 to the exciting coil line 7 of the exciting coil unit 4 so as to be kept at a predetermined fixation (target) temperature (in this embodiment, at 180° C.).

As described above, in such a state that the heating roller 1 and the pressure roller 2 are rotationally driven and the heating roller 1 is caused to generate heat by the power supply to the exciting coil line 7 of the exciting coil unit 4 to be temperature-controlled to the predetermined temperature, the sheet P carrying thereon the unfixed toner image t which has been electrostatically transferred at the transfer portion of the image forming apparatus is introduced into the fixing nip portion N, of the heat fixing apparatus 114 to be nipped and conveyed. During this nip conveyance process, the unfixed toner image t on the sheet P is fixed on the sheet surface as a permanent fixation image by the heat of the heating roller 1 and the nip pressure.

(3) Overheating Prevention of Exciting Coil Unit 4

In this embodiment, in order to solve the above described problems occurring in the case where the exciting coil unit 4 is excessively increased in temperature up to a temperature which is several tens of ° C. higher than 180° C., i.e., a) a lowering in magnetic flux generation efficiency due to an increase in electrical resistance of the exciting coil line 7, and b) a loss of insulating properties due to melting of resinous coating of the exciting coil line 7, a heat pipe 11 having an elongated semicylinder-like shape (FIG. 2(*b*)) as a heat transfer means is disposed inside the heating roller 1 and adjacent to the exciting coil unit 4, so that heat of the exciting coil unit 4 is transferred to the heating roller 1 via the heat pipe 11.

The heat pipe 11 includes a hollow pipe 11*a* having a longitudinally semicylindrical shape and a liquid 11*b* sealed in the hollow pipe 11*a*. The hollow pipe 11*a* is formed in a length exceeding a maximum width Pw (FIG. 3) of a sheet P introduced into the heat fixing apparatus 11*a*2 and includes a heat adsorption portion 11*a*2, having a flat plate-like cross section, disposed in contact with an upper surface of the resinous lid 10 of the exciting coil unit 4 and a heat dissipation portion 11*a*1, having an arcuate cross section, disposed along and opposite to an inner surface of the heating roller 1. The heat pipe 11 has a function such that it absorbs heat of the exciting coil unit 4 in the sealed liquid through the heat absorption portion 11*a*2 of the hollow pipe 11*a* and keeps a temperature of the entire surface of the heat dissipation portion 11*a*1 at a uniform temperature irrespective of an ambient temperature distribution by utilizing latent heat of vaporization of the sealed liquid. In other words, the heat pipe 11 apparently functions as a member having a very high thermal conductivity, so that it can efficiently transfer heat in either of a longitudinal direction (Y direction in FIG. 2(*b*)) and a vertical (cross-sectional) direction (Z direction in FIG. 2(*b*)).

More specifically, during production of the heat pipe, the heat pipe 11 is hermetically processed so that a small amount of water as the liquid is sealed in the heating roller 11 in a vacuum state to prevent ambient air from entering the heat pipe 11. The sealed liquid is not limited to water but may also be a desired aqueous solution. In the case of using water as the sealed liquid, a vaporization (evaporating) temperature varies depending on atmospheric pressure, so that the vaporization temperature is also automatically adjusted so as to be substantially equal to an external temperature of the heat pipe 11 by sealing a certain amount of water within the heat pipe 11. For example, in the case where the heat pipe 11 is heated at 180° C., an inner water vapor pressure is also automatically increased, so that the vaporization temperature also reaches approximately 180° C. Here, the "latent heat of vaporization" will be explained. The heat pipe 11 absorbs external heat from a high-temperature portion of a periphery of the heat pipe 1 in the form of "latent heat of vaporization" associated with vaporization of inner working liquid (water). The vapor of the working liquid (water) is carried to a low-temperature portion within the heat pipe 11 by heat convection within the heat pipe 11 and is liquefied and generates heat at the low-temperature portion. In other words, the working liquid absorbs heat (thermal) energy in the form of the "latent heat of vaporization" and carries the heat energy in the form of vapor to the low-temperature portion by the heat convection, within the heat pipe 11. The "latent heat of vaporization" is considerably larger than a specific heat of a substance, so that an amount of heat transfer utilizing the latent heat of vaporization is also much larger than that by a heat transfer phenomenon of the substance.

In the heat fixing apparatus 114 of this embodiment, temperatures of the heating roller 1 and its inner portion is changed as follows by excessive temperature rise.

The temperature of the heating roller 1 in the neighborhood of the fixation nip portion N is controlled at approximately 180° C.

At an upper surface of the heating roller 1 (in the neighborhood of an upper surface of the heating roller 11) where the heating roller 1 is not adjacent to the exciting coil unit 4, the temperature of the heating roller 1 is approximately 160° C. since heat of the heating roller 1 is absorbed by the sheet P at the fixation nip portion N.

The exciting coil unit 4 is approximately 200° C. due to Joule heat by a current passing through the exciting coil line 7 and heat radiation from the heating roller 1.

As described above, the temperature is about 200° C. at the lower surface of the heat pipe 11 (on the side where the exciting coil unit 4 is disposed) and is about 160° C. at the upper surface of the heat pipe 11, so that heat is transferred from the exciting coil unit 4 to the heating roller 1 through the heating roller 11, i.e., the exciting coil unit 4 is cooled.

According to the heat fixing apparatus 114 of this embodiment, the following effects a)-d) are achieved.

a) Heat of the exciting coil unit 4 is transferred or caused to escape therefrom to the heating roller 1 via the heat pipe 11, so that the heating roller 1 is not cooled as in the conventional heat fixing apparatus, i.e., heat is not vented wastefully. Further, heat due to self heating of the exciting coil unit 4 (heat generation by energization to the exciting coil unit 4) is utilized for toner fixation on the sheet P through the heating roller 1, so that there is no wasted heat, i.e., a heat efficiency is good.

b) Inside the heating roller 1, the heat pipe 11 is disposed adjacent to the exciting coil unit 4, so that a cooling apparatus such as a cooling fan or the like is not required to be disposed at the periphery of the heat fixing apparatus and it is possible to reduce a size of the image forming apparatus.

c) The heat pipe 11 is caused to directly contact the exciting coil unit 4, so that a heat conduction (transfer) efficiency from the exciting coil unit 4 to the heat pipe 11 is good, thus resulting in a good cooling efficiency of the exciting coil unit 4.

d) As described in a) to c), the exciting coil unit 4 fan be cooled efficiently, so that it is possible to suppress an increase in electrical resistance of the exciting coil line 7 and a lowering in generation efficiency of magnetic flux.

In the above constituted heat fixing apparatus 114, the heat pipe 11 is required to be disposed as close to the inner surface of the heating roller 1 as possible in order to permit smooth heat transfer from the heat pipe 11 to the inner surface of the heating roller 1. More specifically, a distance d between an outer surface of the heat dissipation portion of the hollow pipe 11*a* and the inner surface of the heating roller 1 is required to be ensured as small as possible, and a length L of an arcuate portion (hereinafter referred to as a "contact length L") where the hollow pipe 11*a* and the exciting coil unit 4 are disposed opposite to each other with a predetermined gap (0.3-5 mm) in a circumferential direction of the inner surface of the heat pipe 11 is required to be ensured as long as possible. On the basis of experimental data, it is desirable that the contact length L is not less than 10 mm or not less than ⅕ of an inner circumferential length of the heating roller 1. This value is attributable to such a fact that an amount of heat transfer depends on a contact area, i.e., the contact length L or a ratio of the contact length to the inner circumferential length of the heating roller, so that heat of the exciting coil unit 4 cannot be caused to escape therefrom when the contact length L is 1 mm or 2 mm.

As for the distance d, in the case where a rotation speed of the heating roller 1 is relatively low, a sliding performance between the heat pipe 11 and the heating roller 1 is improved and the heat dissipation portion 11*a*1 of the heat pipe 11 and the inner surface of the heating roller 1 may be in contact with each other, i.e., d=0. In this case, in order to improve the sliding performance between the heat pipe 11 and the heating roller 1, a heat-resistant lubricating oil (also having a function of decreasing a heat resistance of a contact surface) may be applied onto the inner surface of the heating roller 1. Further, in the case where the image forming apparatus 100 is a high-speed copying machine, it is difficult to ensure the contact state since the heating roller 1 is also rotated at high speed. Even in such a case, however, it has been empirically clarified that it is possible to ensure an amount of heat transfer necessary to cool the exciting coil unit 4 by keeping the distance d at a level of not more than 5 mm. In this case, however, the distance d has a limit of 0.3 mm in view of dimensional tolerance and mounting tolerance of respective parts (the heating roller 1 and the heat pipe 11), so that the distance d is 0.3-5 mm in the case where both the parts are in noncontact with each other.

Second Embodiment

Figure 4:
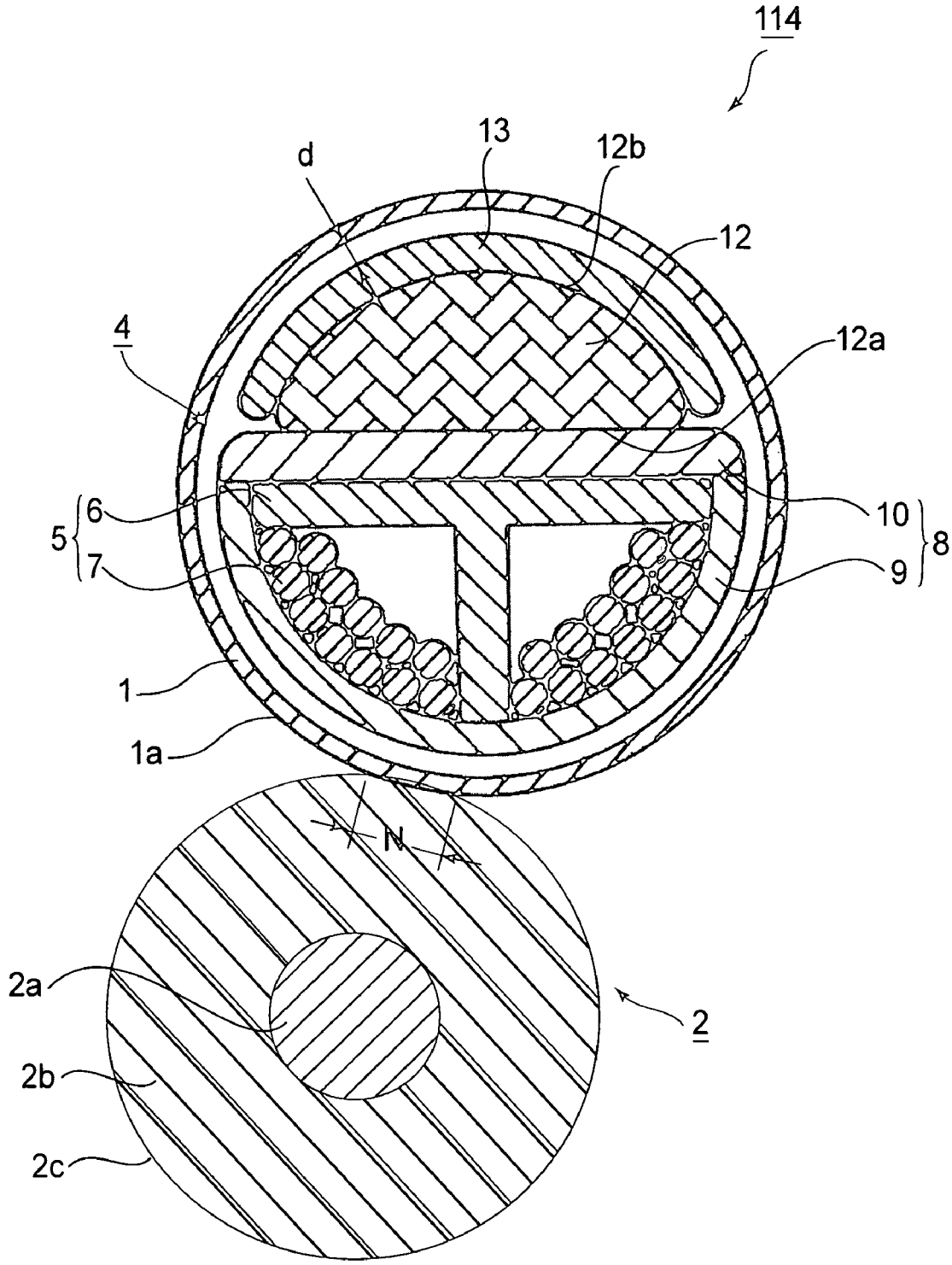
FIG. 4 is a schematic cross-sectional view of a heat fixing apparatus according to Second Embodiment.
Figure 5:
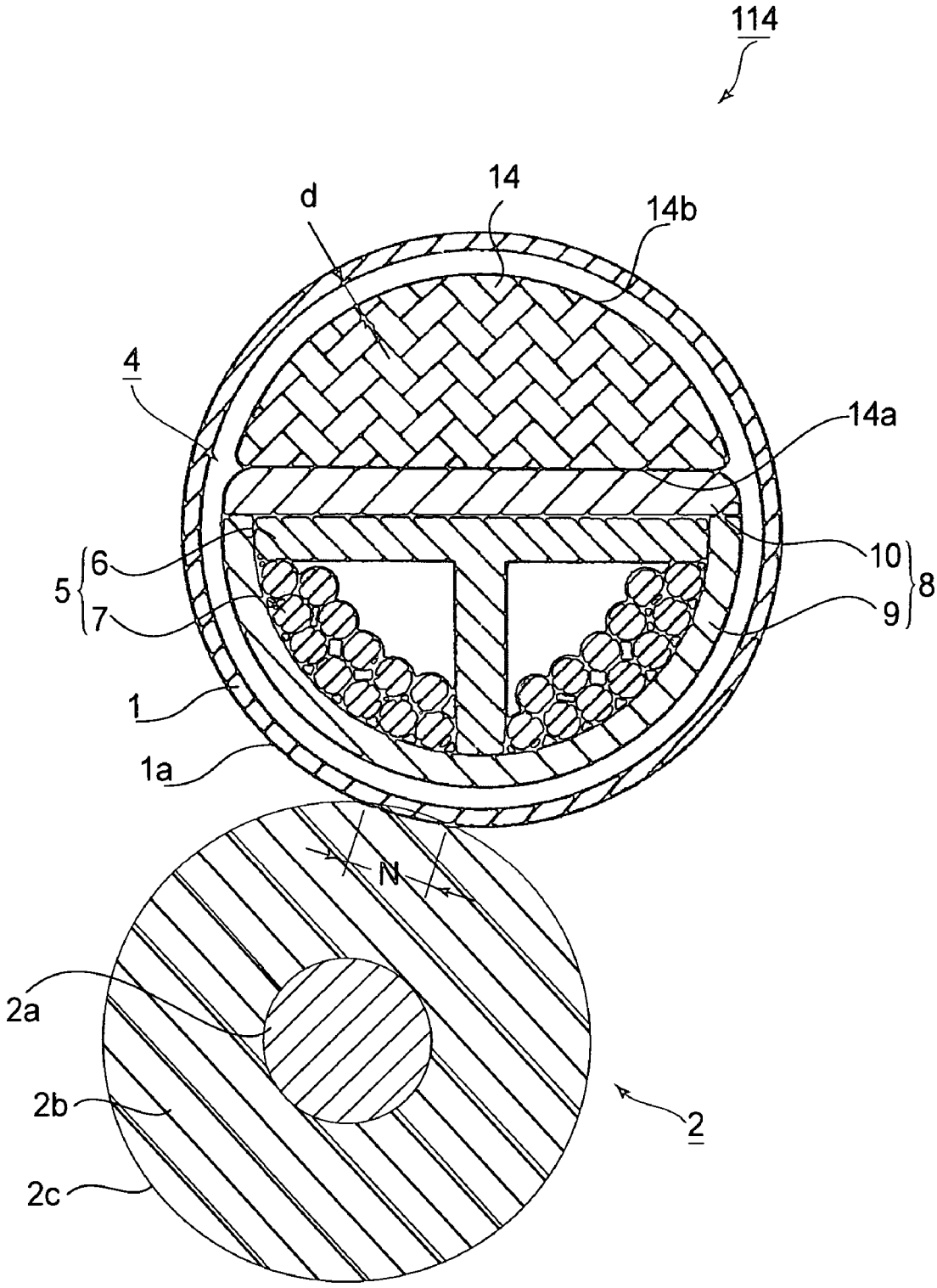
FIG. 5 is a schematic cross-sectional view of a heat fixing apparatus according to Third Embodiment.

Second Embodiment of those heat fixing apparatus according to the present invention will be described with reference to FIG. 4 showing a cross-sectional constitutional view of a heat fixing apparatus according to this embodiment.

A heat fixing apparatus 114 of this embodiment is different from that of First Embodiment in that a heat transfer means is constituted by an aluminum block 12 as a nonmagnetic high (good) heat-conductive member and a Peltier cooling device 13 as a heat pump means.

More specifically, the heat fixing apparatus 114 of this embodiment is configured so that the aluminum block 12 is disposed adjacent to the exciting coil unit 4 inside the heating roller 1 and the Peltier cooling device 13 is disposed adjacent to the aluminum block 12.

The aluminum block 12 is formed in an almost semicylindrical shape at its cross section and includes a planar heat absorption portion 12*a* at a lower surface thereof contacting the upper surface of the resinous lid 10 of the exciting coil unit 4 and an arcuate heat dissipation portion 12*b* at an opposite upper surface thereof apart from the exciting coil unit 4. The aluminum block 12 has a function of absorbing heat of the exciting coil unit 4 at the heat absorption portion 12*a* and dissipating the heat from the heat dissipation portion 12*b*. The Peltier cooling device 13 is formed in an arcuate cross sectional shape along the inner surface of the heating roller 1 and is disposed in contact with the heat dissipation portion 12*b* of the aluminum block 12 so as to substantially cover the entire surface of the heat dissipation portion 12*b*. The Peltier cooling device 13 functions as a so-called heat pump for transferring the heat of the exciting coil unit 4 to the heating roller 1 through the aluminum block 12.

The heat pump means is not particularly limited but the Peltier cooling device excellent in space saving performance is an optimum means.

The above constituted heat fixing apparatus 114 can transfer the heat of the exciting coil unit 4 to the Peltier cooling device 13 via the aluminum block 12 and can dissipate the heat into the heating roller 1 through the Peltier cooling device 13, i.e., can heat the heating roller 1 by providing the heat to the heating roller 1.

Accordingly, also in the heat fixing apparatus 114 of this embodiment, it is possible to achieve the same function and effect as those in the case of using the above described heat pipe 11. Particularly, in this embodiment, the Peltier cooling device (heat pump) is utilized, so that the heat fixing apparatus of this embodiment is advantageous in that the exciting coil unit 4 can be cooled even in the case where there is a small difference in temperature between the exciting coil unit 4 and the heating roller 1 or the temperature of the heating roller 1 is higher than that of the exciting coil unit 4. Incidentally, the exciting coil unit 4 generates strong magnetic field, so that there is a possibility that an operation of the Peltier cooling device 13 is adversely affected by the magnetic field. In this embodiment, however, the magnetic field is blocked by the aluminum block 12 formed of aluminum which is a nonmagnetic material, thus being of no problem.

Also in this embodiment, in the case where the rotation speed of the heating roller 1 is relatively low, the surface of the Peltier cooling device 13 and the inner surface of the heating roller 1 may be caused to contact each other, i.e., d=0. In this case, a heat-resistant lubricating oil may be applied onto the inner surface of the heating roller 1. Further, in the case where the surface of the Peltier cooling device 13 and the inner surface of the heating roller 1 are not caused to contact each other, the distance d may be 0.3-5 mm.

Third Embodiment

Third Embodiment of those heat fixing apparatus according to the present invention will be described with reference to FIG. 4 showing a cross-sectional constitutional view of a heat fixing apparatus according to this embodiment.

A heat fixing apparatus 114 of this embodiment is different from that of First Embodiment in that the heat pipe 11 as a heat transfer means is replaced with a nonmagnetic high (good) heat-conductive member (heat transfer member) 14.

The good reason why the good heat-conductive member 14 is formed of the nonmagnetic material is that it is prevented from being heated by a magnetic field of the exciting coil unit 4. It has been empirically clarified that a heat conductivity of the good heat-conductive member 14 is enough if it is not less than 1 heat conductivity of an ordinary metallic material such as iron, aluminum or copper, i.e., not less than 50 kcal/(m.h. ° C.). In view of this point, aluminum is suitable as a material for the good heat-conductive member 14.

The good heat-conductive member 14 is formed in an almost semicylindrical shape at its cross section and includes a flat heat absorption surface (heat-receiving portion) 14*a* at a lower surface thereof contacting the upper surface of the resinous lid 10 of the exciting coil unit 4 and an arcuate heat dissipation surface (heat dissipation portion) 14*b* at an opposite upper surface thereof apart from the exciting coil unit 4 and along with the inner surface of the heating roller 1.

Accordingly, also in the heat fixing apparatus 114 of this embodiment, it is possible to achieve the same function and effect as those in the case of using the above described heat pipe 11. Particularly, in this embodiment, the heat pipe 11 can be advantageously replaced with an inexpensive aluminum block or the like.

Also in this embodiment, in the case where the rotation speed of the heating roller 1 is relatively low, the heat dissipation surface 14*a* of the good heat-conductive member 14 and the inner surface of the heating roller 1 may be caused to contact each other, i.e., d=0. In this case, a heat-resistant lubricating oil may be applied onto the inner surface of the heating roller 1. Further, in the case where the heat dissipation surface 14*b* of the good heat-conductive member 14 and the inner surface of the heating roller 1 are not caused to contact each other, the distance d may be 0.3-5 mm.

As described above, in the heat fixing apparatuses 114 of First to Third Embodiments, the heat transfer means (the heat pipe 11, the combination of the heat pump means such as the Peltier cooling device with the good heat-conductive member such as the aluminum block 12, or the good heat-conductive member such as the aluminum block 14) is disposed adjacent to the exciting coil unit 4 inside the heating roller 1 to cause the heat of the exciting coil unit 4 to escape therefrom into the heating roller 1, so that the heating roller 1 is not cooled as in the conventional heat fixing apparatus, i.e., the heat is not wastefully vented. Further, the heat of the exciting coil unit 4 due to its self-heating is utilized for heat fixation of an image on the sheet P through the heat transfer means and the heating roller 1, so that there is no wasteful heat, i.e., a heat efficiency is good. Accordingly, it is possible to efficiently cool the exciting coil unit 4 without cooling the heating roller 1.

Other Embodiments

1) The heat generation member is not limited to the roller-shaped member but may also be an endless film or belt member which has an electromagnetic heat generation layer and flexibility.

2) The image heating apparatus according to the present invention may also be effectively used, in addition to the image heating apparatus as in the above described embodiments, as image heating apparatuses such as a preliminary fixing apparatus for preliminarily fixing an unfixed image on a material to be subjected to recording and a surface-modifying apparatus for modifying image surface properties such as gloss and so on by re-heating a fixed image-carried member to be subjected to recording.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 135118/2005 filed May 6, 2005, which is hereby incorporated by reference.

What is claimed is:

1. An image heating apparatus, comprising:

a coil for generating magnetic flux;

a core;

a coil unit supporting said coil and said core;

a rotatable image heating member, provided with said coil unit therein, for generating heat by magnetic flux generated by said coil to heat an image on a recording material; and a heat transfer member, in which liquid is filled, having a first surface that is in contact with said coil unit and a second surface that is in contact with or spaced 0.3-5 mm from an inner surface of said image heating member, wherein said core is disposed between said coil and said heat transfer member.

2. An apparatus according to claim 1, wherein the second surface of said heat transfer member has a width, along a moving direction of said image heating member, of not less than 10 mm.

3. An apparatus according to claim 1, wherein the second surface of said heat transfer member has a width, along a moving direction of said image heating member, of not less than ⅕ of an inner circumferential surface of said image heating member.

4. An apparatus according to claim 1, wherein both of a surface of said coil unit contacting the first surface and the first surface are flat surfaces.

* * * * *